US005788169A

United States Patent [19]

Koenig

[11] Patent Number: 5,788,169

[45] Date of Patent: Aug. 4, 1998

[54] MODULAR SHEAR SHREDDER

[76] Inventor: Larry E. Koenig, c/o Komar Industries, Inc. 4425 Marketing Pl., Groveport, Ohio 43125

[21] Appl. No.: 597,664

[22] Filed: Feb. 7, 1996

Related U.S. Application Data

[62] Division of Ser. No. 476,096, Jun. 7, 1995, which is a division of Ser. No. 69,874, Jun. 1, 1993, Pat. No. 5,484,112.

[51] Int. Cl.[6] ..... B02C 18/06

[52] U.S. Cl. ..... 241/236; 241/285.2; 83/502

[58] Field of Search ..... 241/236, 235, 241/285.2, 285.3, 287, 288, 101.2; 83/502

[56] References Cited

U.S. PATENT DOCUMENTS

| | | | |
|---|---|---|---|
| 1,994,137 | 3/1935 | Leguillon | 83/502 X |
| 2,554,071 | 7/1951 | Strawn | 241/285.2 |
| 3,220,658 | 11/1965 | Shelton | 241/285.2 |
| 4,609,155 | 9/1986 | Garnier | 241/30 |
| 4,844,363 | 7/1989 | Garnier | 241/224 |
| 4,905,910 | 3/1990 | Wuestmer | 241/101.2 |
| 5,205,495 | 4/1993 | Garnier | 241/31 |
| 5,328,107 | 7/1994 | Tsai | 241/236 |

FOREIGN PATENT DOCUMENTS

| | | | |
|---|---|---|---|
| 9112890 | 9/1991 | WIPO | 241/236 |

OTHER PUBLICATIONS

Hi–Torque Shredders, Hi–Torque Shredder Co.

Shredding Systems, Inc. brochure, 1985.

Press Release, Newell, Oct. 26, 1989.

The Shredders, Officine Meccaniche Pieraugelo Colombo, 1982.

Mitts & Merrill Cutters, 1983.

Garbalizer Machinery Corporation brochure.

Ceurtro–Mogardshammer AB, Shredder Type SK.

Shred–Tech Limited Brochure.

Saturn Shredders, MAC Corporation, 1986.

*Primary Examiner*—Douglas D. Watts

*Attorney, Agent, or Firm*—Thompson Hine & Flory LLP

[57] ABSTRACT

A modular shear shredder having at least one shear cartridge having a shaft which carries a plurality of cutter elements mounted within a shredder housing having a support frame, opposing end walls attached to the frame, and side walls removably attached to the frame, the side walls being shaped such that removal of the one of the side walls permits the shear cartridge inserted and removed from the shredder housing. Consequently, there is no need to remove the end walls of the housing, or otherwise dismantle the unit to remove the shear cartridge. The removable side walls each support a plurality of comb elements which mesh with the cutter elements on the shear cartridge. Each shear cartridge within the shredder includes a pair of end caps removably attached to the ends of the shaft. The caps are shaped to be attached either to support bearings or drive motor output shafts. The end walls of the housing are modular and are adapted to support either support bearings or drive motors, so that the unit can be configured such that a pair of drive motors powers each shear cartridge, or a single drive motor powers a shear cartridge. The shredder includes a feed hopper having a ram which reciprocates toward and away from the open top of the housing. The ram includes a ram face which is pivotable between an operative position and a collapsed position, whereby the space within the feed hopper is not obstructed by the ram when not needed.

10 Claims, 10 Drawing Sheets

MODULAR SHEAR SHREDDER

This is a divisional of application Ser. No. 08/476,096 filed Jun. 7, 1995, which is a divisional of application Ser. No. 08/069,874 filed Jun. 1, 1993, now U.S. Pat. No. 5,484,112.

BACKGROUND

The present invention relates to systems for shredding materials and, more particularly, to shear shredders in which cutting elements reduce material size.

Shear shredders are well known and are commonly used to reduce material size so that the overall volume of material is reduced for storage or transportation, or so that particle size of the material is reduced to promote burning or combustion of the material in an incinerator or kiln. The most common application for shear shredders is in the field of waste disposal; shear shredders are particularly effective in reducing such items as rubber vehicle tires to chip sizes which promote the burning of the tire material.

A typical shear shredding system is disclosed in U.S. Pat. No. 4,844,363 and includes a support frame which has an open top and bottom and houses a pair of shredder blade assemblies. Each shredder blade assembly includes a central shaft and a plurality of individual, disk-shaped cutter elements. The cutter elements are spaced apart from each other on the shaft so that a pair of cutter assemblies may be positioned so that the cutter elements mesh with each other. The shredder blade assemblies are counter-rotated relative to each other by a single drive motor and gearbox.

Such shredder systems include a feed hopper which is mounted on top of the housing and communicates with the open top of the support frame. The feed hopper includes a feed ram which is protected within the hopper by its own housing and includes a ram face which is reciprocated toward and away from the open top of the support frame and cutting elements by a double-acting cylinder.

It is typical with all such shredder systems that the cutter assemblies are difficult to insert and remove for maintenance, which results in relatively long periods of down time. Such down time subtracts from the productivity of the shear shredder in processing waste material. Another advantage with presently-known shear shredder systems is that the systems must be custom-designed for a particular application. That is, the major components, such as the cutter assemblies, support bearings, drive motors and housing walls cannot be interchanged and reassembled to form shear shredders of different configurations.

Accordingly, there is a need for a shear shredder design in which components, such as the shear cutter assemblies, can be removed and inserted in the field with a minimum of down time. Further, there is a need for a shear shredder having a feed ram which collapses when not in use to provide a maximum opening to the cutter elements. There is also a need for a shear shredder which is of modular construction such that an inventory of components can be maintained to be assembled into a number of different shredder configurations.

SUMMARY OF THE INVENTION

The present invention is a modular shear shredder in which the cutter elements are mounted on shear cartridges which can be inserted and removed from the shredder housing sidewardly by moving a side wall section, thereby eliminating the need for removal or disassembly of bearings, gear drives or the feed hopper. The shear cartridge includes a shaft which supports a plurality of cutter elements that are held in position by end caps which are mounted on the ends of the shaft. The end caps have flat end surfaces which are adapted to be connected to either support bearings or drive motors. Consequently, there is no need to provide an inventory of specialized end caps which are needed for particular types of connections.

The shear cartridges are mounted within a support frame having opposing, removable side walls and removable end walls. The side walls are shaped such that the shear cartridges are insertable and removable through the openings formed by the removal of the side walls. The shear cartridges are connected either to drive motor shafts or support bearings mounted on the support frame end walls and are suspended between the motors and/or bearings. Accordingly, removal of the shear cartridges is accomplished by removal of the side wall and subsequent disengagement of the shear cartridge from the bearings and/or drive motors to which it is attached.

The end walls are modular and are shaped to support either support bearings or hydraulic drive motors. Consequently, a shear shredder having a pair of meshing shear cartridges can be designed such that a pair of drive motors drives each shear cartridge (making four drive motors for the system), or such that each shear cartridge is driven by a single drive motor at one end and is supported by a support bearing at the opposite end.

In the preferred embodiment, each shear cartridge of a dual cartridge system is driven by a pair of hydraulic drive motors. The hydraulic drive motors are each driven by a single, dedicated hydraulic pump. A pair of electric motors drives the pumps and the pumps are arranged such that each motor drives two pumps, and each of the pumps driven by a given motor is connected to a hydraulic drive motor on a different cartridge. With such an arrangement, should one shear cartridge become immobilized due to a jam, the entire motive force of the electric drive motors which power the pumps is dedicated to the single jammed shear cartridge so that the extra power operates to free the jam.

Also in the preferred embodiment, the removable side walls each support a plurality of comb elements which are spaced to mesh with the cutter elements of a shear cartridge. Accordingly, removal of the side wall disengages the comb elements from the cutter elements on a shear cartridge, thereby facilitating the replacement of the shear cartridge as well as the replacement of the comb elements. The comb elements are easily removable from the side wall on which they are mounted.

The preferred embodiment of the modular shear shredder includes a feed hopper having a feed ram mounted within the hopper. The feed ram includes a double-acting cylinder which advances and retracts the ram relative to the open top of the support frame, a ram face which is pivotally attached to the cylinder, and a second cylinder which pivots the ram face to an operative position, where it is positioned to urge material in the hopper toward the shear cartridges, or to a collapsed position in which the ram face is pivoted against the adjacent side wall of the hopper. The ram face includes a ram face shield which is pivotally attached to the ram face and extends upwardly to be pivotally attached to a housing which encloses the second cylinder which pivots the ram face. This face shield prevents material within the hopper from falling behind the ram face. The ram face, ram face cylinder and ram face cylinder housing are all mounted on a slide plate which is positioned adjacent to the side wall of the hopper. The primary cylinder, which advances the ram face, is mounted outside the hopper and therefore is easily accessible for maintenance and replacement.

Accordingly, it is an object of the present invention to provide a modular shear shredder which can be attached and removed with a minimum of down time; a shear shredder having removable side walls to facilitate replacement of shear cartridges and comb elements; a shear shredder having modular end walls are adapt to support either support bearings or hydraulic drive motors; a shear shredder having a hydraulic drive system in which the power of the hydraulic motors is fully devoted to a jammed shear cartridge; a shear shredder having a feed hopper with a feed ram which collapses to maximize the feed hopper opening when the ram is not in use; a shear shredder which is rugged in construction; and a shear shredder which is made of modular components that can be assembled in a variety of configurations.

Other objects and advantages of the present invention will be apparent from the following description, the accompanying drawing and the appended claims.

DETAILED DESCRIPTION

Figure 1:
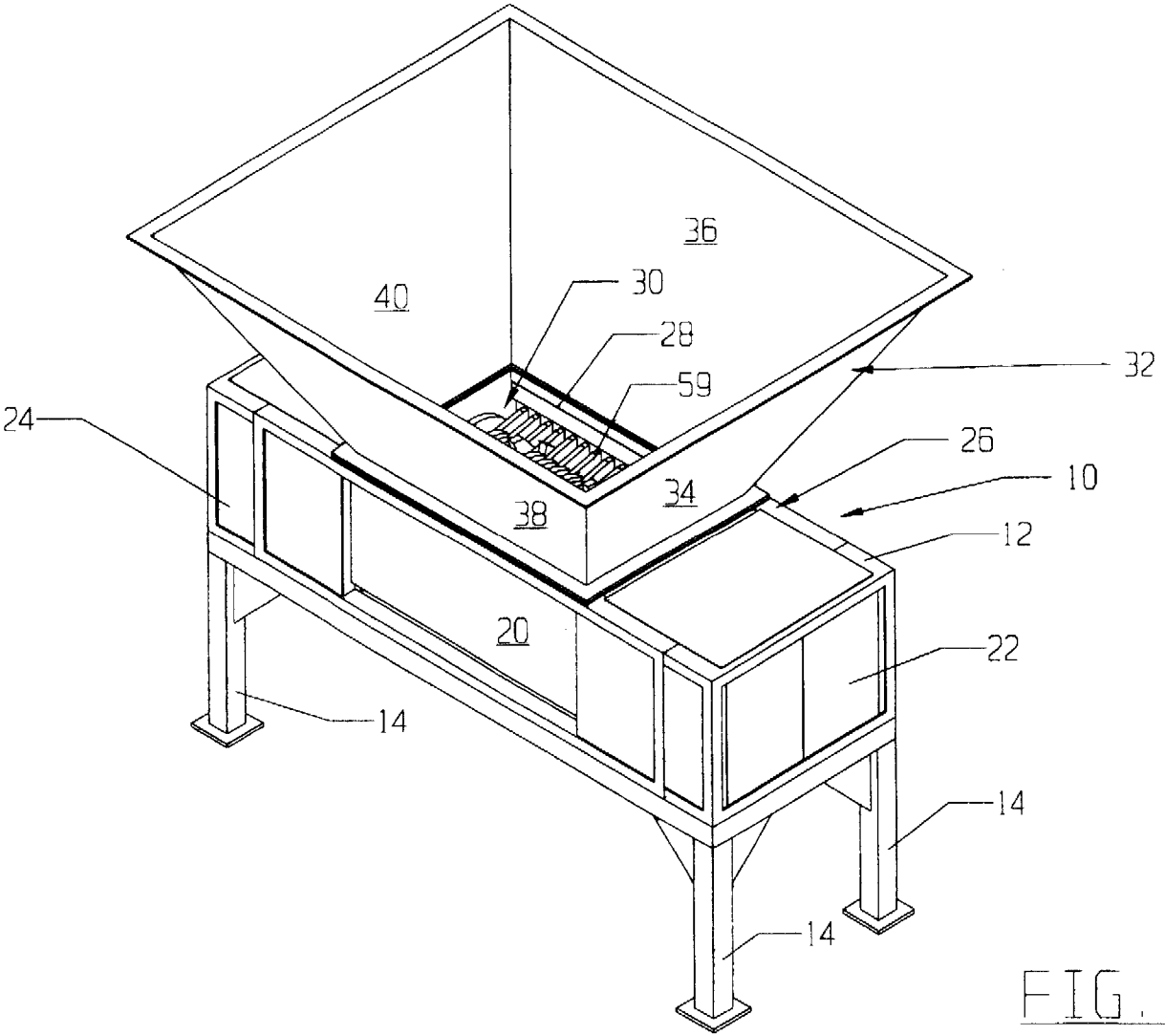
FIG. 1 is a perspective view of a modular shear shredder of the present invention.
Figure 3:
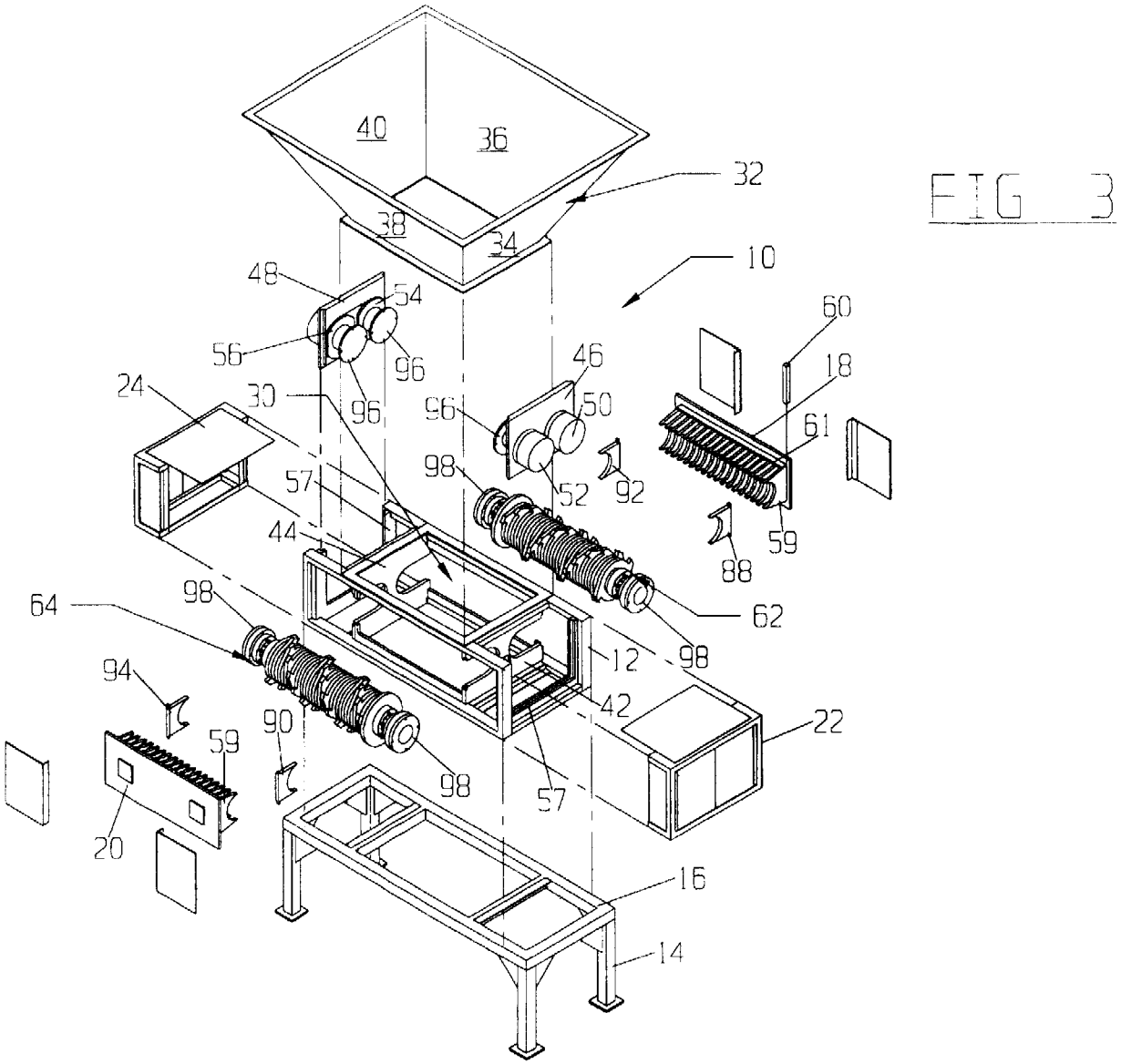
FIG. 3 is an exploded, perspective view of the shear shredder of FIG. 1.

As shown in FIGS. 1, and 3, the shear shredder of the present invention, generally designated 10, includes a support frame 12, which is mounted above grade on four support legs 14. The support legs 14 are part of a base frame 16 which supports the frame 12. The support frame 12 receives removable side walls 18, 20 and removable end housings 22, 24. The side walls 18, 20 preferably are bolted to the frame 12, as are the end housings 22, 24.

The support frame 12, side walls 18, 20 and end wall housings 22, 24 form an enclosure, generally designated 26, having an open top 28 which allows material to enter the interior grinding chamber 30 of the shear shredder. A hopper 32 having downwardly-converging side walls 34, 36, 38, 40 is mounted on the shredder housing 26 and communicates with the open top 28.

The grinding chamber 30 is defined by the side walls 18, 20 and grinding chamber end walls 42, 44. The frame end walls 46, 48 are removably attachable to the ends of the support frame 12 by bolts or machine screws (not shown), and support drive motors 50, 52, 54, 56, respectively. The end walls 46, 48 are attached to U-shaped brackets 57 which are machined for precision and welded to the frame 12 in precise alignment with respect to each other. In the preferred embodiment, the walls 46, 48 are dowelled for location.

The side walls 18, 20 are also removably attachable to the support frame 12 by bolts or machine screws, (not shown). Each of the side walls 18, 20 supports a plurality of spaced comb elements 59. Comb elements 59 are sperate by spacers 60 and are retained on side walls 18, 20 by rails 61, bolted to the walls, which capture tabs protruding from the base of the elements.

Figure 2:
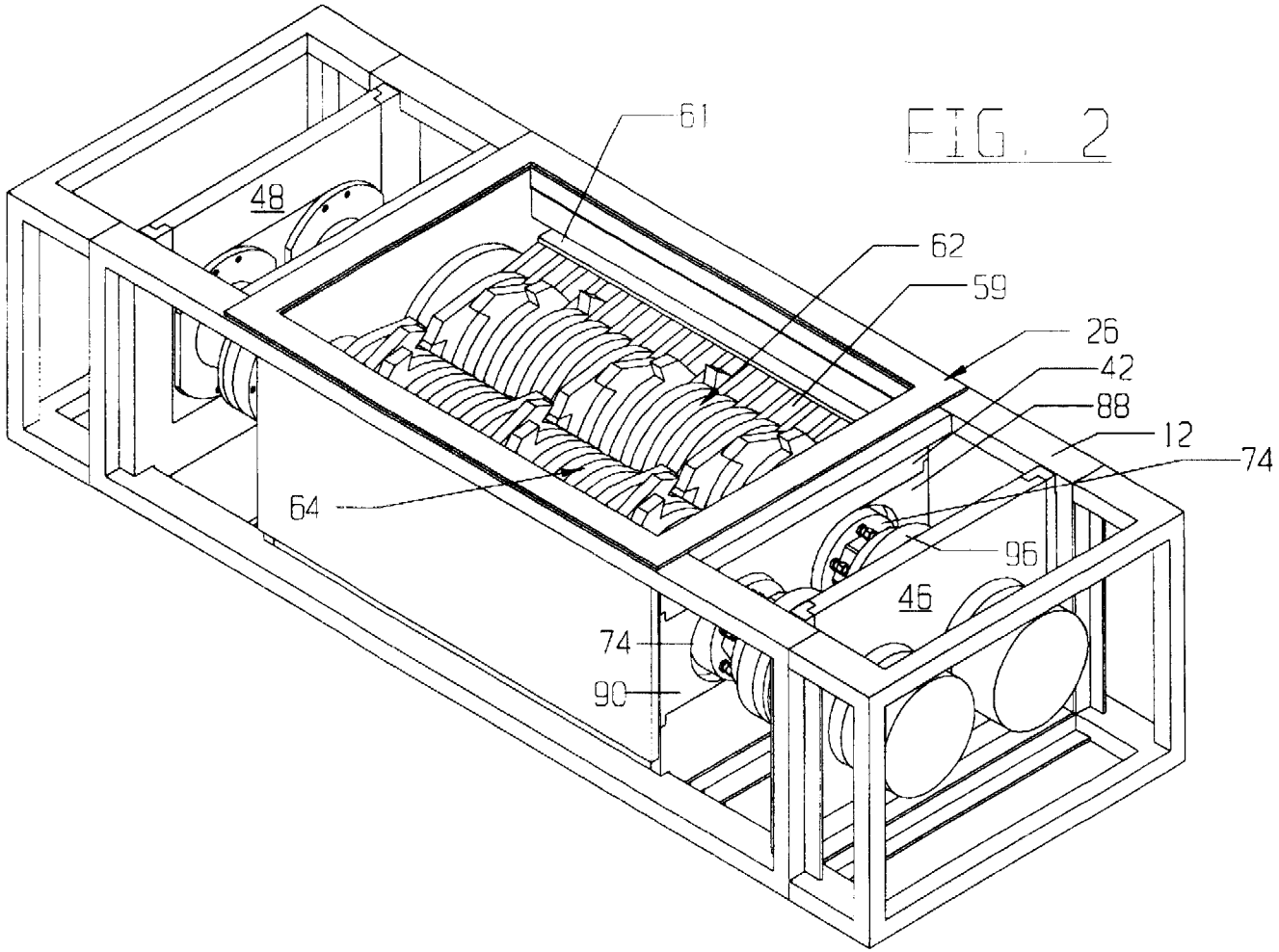
FIG. 2 is a perspective view of the support frame and shear cartridge assembly of the shear shredder of FIG. 1.
Figures 4A, 4B:
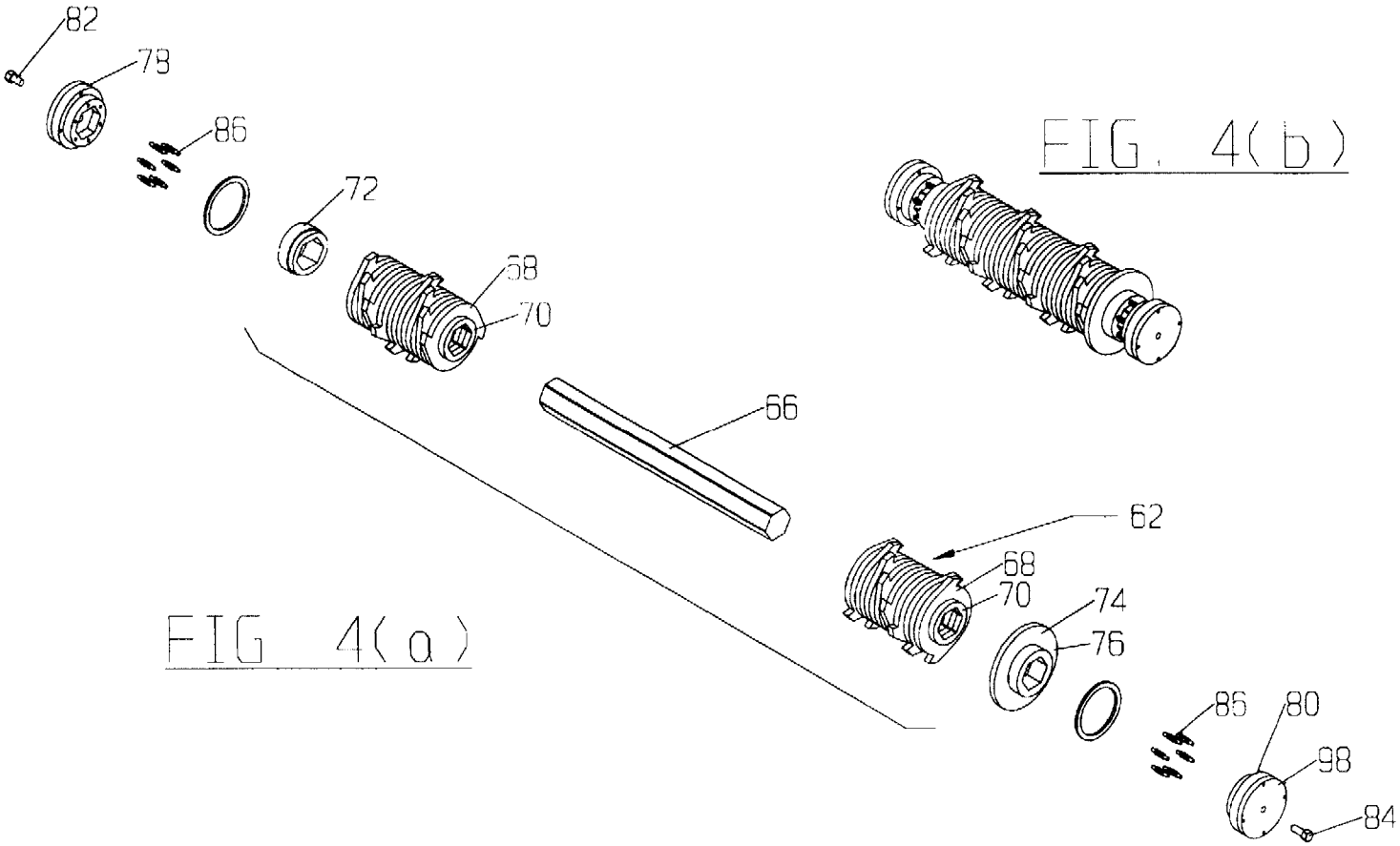
FIG. 4 is an exploded, perspective view of a shear cartridge of the shear shredder of FIG. 1.

A pair of shear cartridges 62, 64 are mounted within the support frame 12. As shown in FIGS. 2 and 4, each shear cartridge includes a hexagonal shaft 66 on which is mounted a plurality of cutter elements 68, each of the cutter elements being separated from its neighbor by a spacer ring 70. The cutter elements 68 and spacer rings 70 each include hexagonal central openings to prevent rotation relative to the shaft 66. Outside of the array of cutter element 68 and spacers 70 are small 72 and large 74 stack tighteners. The small and large stack tighteners 72, 74 each have a central, hexagonal opening to receive the shaft 66, and large stack tighteners 74 include a peripheral flange 76. The array of cutter elements 68, spacer 70 and stack tighteners 72, 74 are held on the shaft 66 by end caps 78, 80. End caps 78, 80 are retained on the ends of the shaft 66 by screws 82, 84, respectively. Jam nut and wedge bolt combinations 86 extend between the end cap 80 and stack tightener 72, 74. The jam nut and wedge bolt combinations are adjusted to urge the stack tighteners 72, 74 inwardly toward the shaft 66 to tighten the cutter elements 68 and spacers against each other.

As shown in FIGS. 1 and 2, the shear cartridges 62, 64 are positioned within the support frame 12 so that the stack tighteners 72, 74 are adjacent to the grinding chamber end walls 42, 44. The flange on stack tightener 74 is adjacent to a spacer 70 and serves as a shield to prevent contaminants from passing through the wall 42. The walls 42, 44 each include inserts 88, 90, 92, 94 which complete the continuity of the end walls 42, 44 to define the grinding chamber 30.

Each of the hydraulic drive motors 50–56 includes a flat attachment plate 96 mounted on its output shaft. The flat plates 96 bolt to the faces 98 of the end caps 78, 80 of the shear cartridges 62, 64.

Figure 5A:
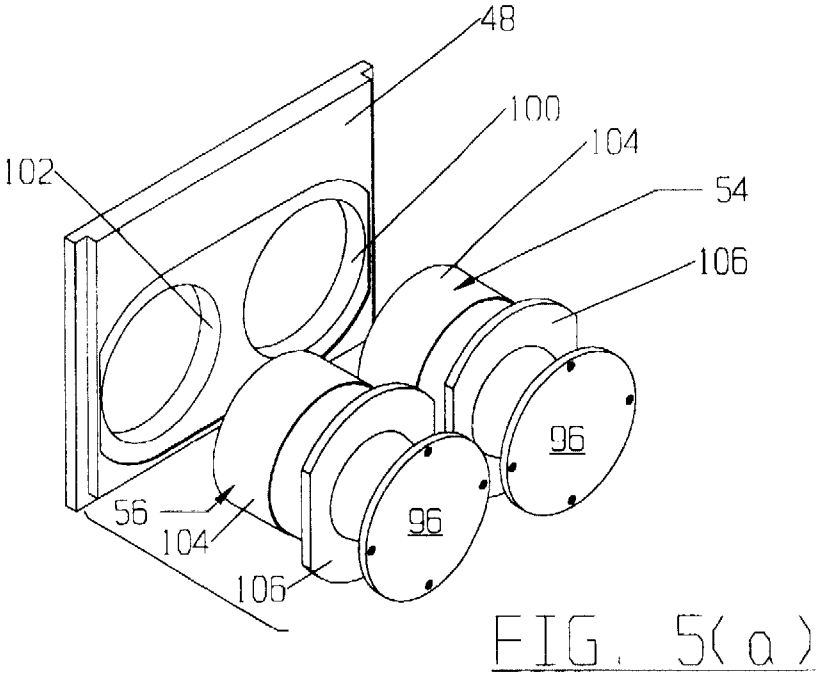
FIG. 5 is an exploded, perspective view of an end wall of the shear shredder of FIG. 1 in which the drive motors have been removed.
Figure 5B:
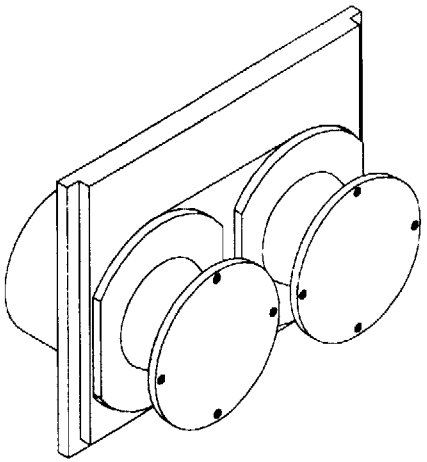

As shown in FIG. 5 for end wall 46, the end walls 46, 48 include openings 100, 102 which receive the housings 104 of the motors 54, 56. The housing flanges 106 of the motors 54, 56 are ground to permit close spacing of the motors and are attached to the walls by bolts or machine screws (not shown).

Figure 10:
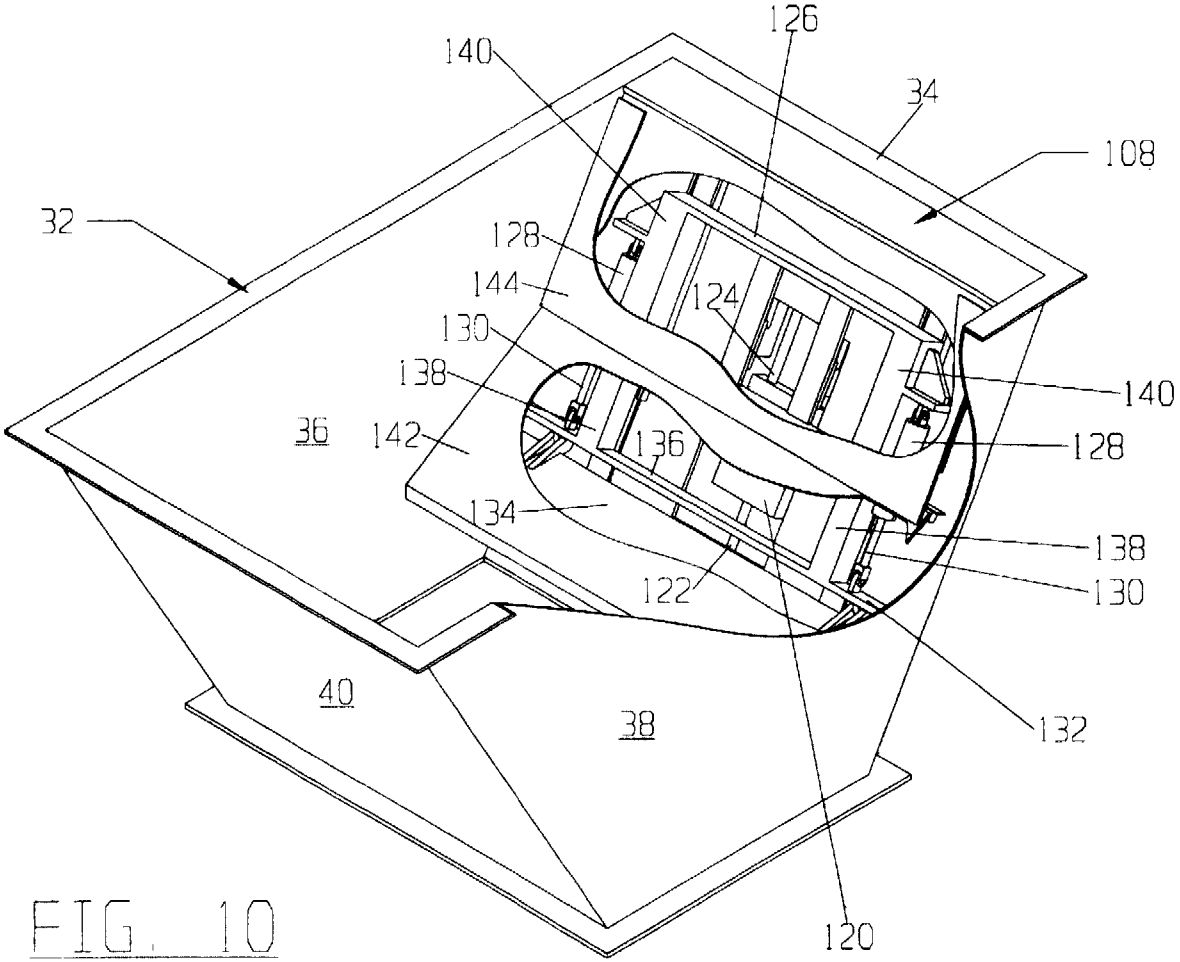
FIG. 10 is a perspective view of the hopper of the shredder of FIG. 1, broken away to show feed ram components.

As shown in FIG. 10, the hopper 32 includes a feed ram, generally designated 108, which is mounted on hopper side wall 34. Side wall 34 includes longitudinal reinforcing bars 110, 112 and lateral struts 114, 116, which extends between the reinforcing bars, and frame and opening 118 formed in the side wall 34. A primary double-acting cylinder 120 is mounted so that a first cylinder rod 122 is attached to lateral strut 116 and second and third rods 124 are attached to a slider plate 126 (see also FIGS. 7 and 10). The cylinder 120 is covered by access plate 127. Such a cylinder 120 is shown in greater detail in co-pending U.S. patent application Ser.

No. 07/993,123, filed Dec. 21, 1992, the disclosure of which is incorporated herein by reference.

The slider plate 126 is shaped to cover the opening 118 completely when cylinder rod 122 is extended and retracted.

Secondary cylinders 128 (See FIG. 10) are pivotally mounted on slider plate 126 and include rods 130 which are pivotally attached to a ram assembly, generally designated 132. Ram assembly includes a ram face 134 which is pivotally attached to a support frame 136 having legs 138 which telescope into sections 140 of the slider plate 126.

A ram shield 142 is pivotally connected to the ram face 134 at a lower end and is pivotally connected to the slider plate 126 at an upper end. The slider plate and ram assembly 132 are covered by a plate 144. The plate 144 and shield 142 act together to prevent waste material from falling behind the ram face 134.

Figure 8:
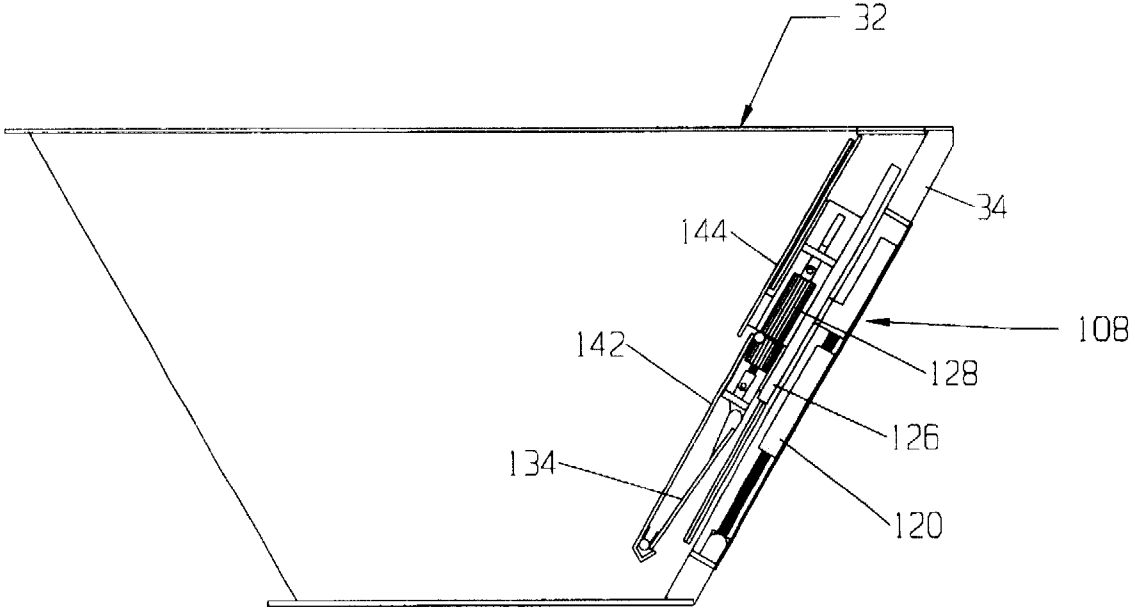
FIG. 8 is the hopper of FIG. 7 in which the ram feed is in a collapsed position.
Figure 9:
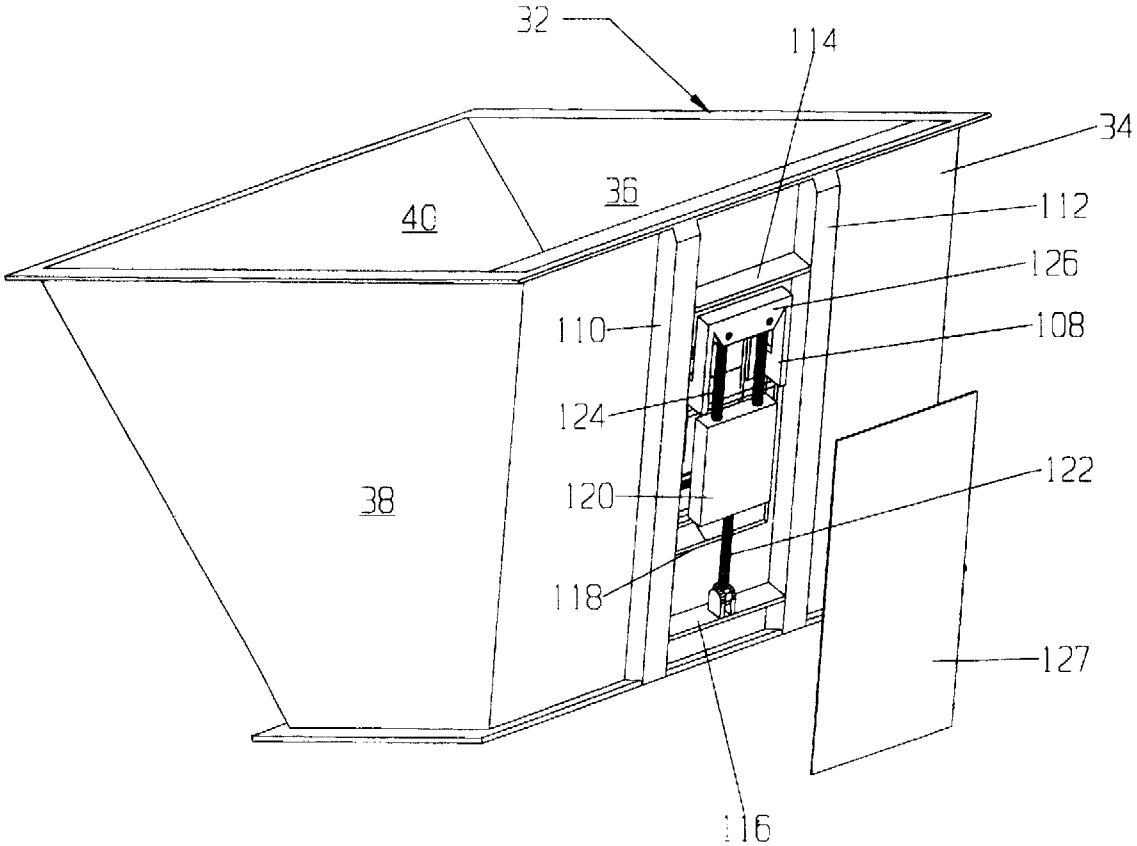
FIG. 9 is an exploded, perspective view showing the feed ram of the shear shredder of FIG. 1 in which an access plate covering the primary cylinder of the ram feed has been removed.

As shown in FIG. 8, when the secondary cylinder 128 is retracted, the ram assembly is drawn upwardly relative to the slider plate 126. This causes the ram face 134 to pivot toward the side wall 34 of the hopper 32. At the same time, the shield 142 pivots relative to the slider plate 126 as well, and forms a substantially planar surface with plate 144. In this collapsed configuration, the feed ram 108 presents a low profile and a minimal obstruction within the hopper 32.

Figure 7:
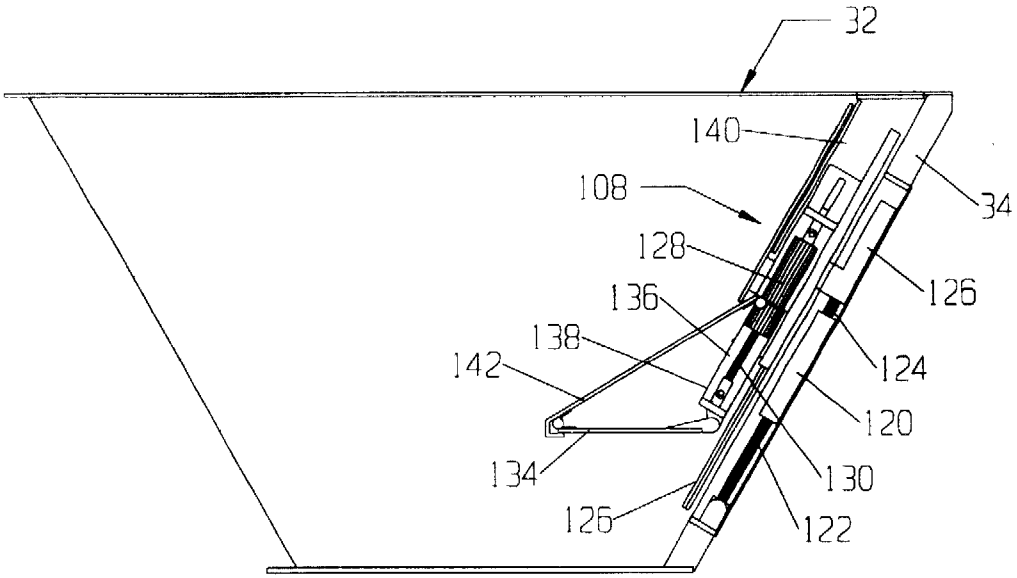
FIG. 7 is a side elevation in section of the feed hopper of the shear shredder of FIG. 1, in which the ram feed is shown in the operative position.

As shown in FIG. 7, when it is desired to activate the feed ram 108, the secondary cylinders 128 are actuated to extend their rods 130, thereby displacing the ram assembly downwardly relative to the slider plate 126. This relative movement causes the ram face 134 to pivot outwardly to an operative position. The ram face may then be reciprocated relative to the hopper 32 and side wall 34 by primary cylinder 120 to urge material downwardly through the open top 28 and into the grinding chamber 30 (See FIG. 1) of the shear shredder 10.

Figure 6:
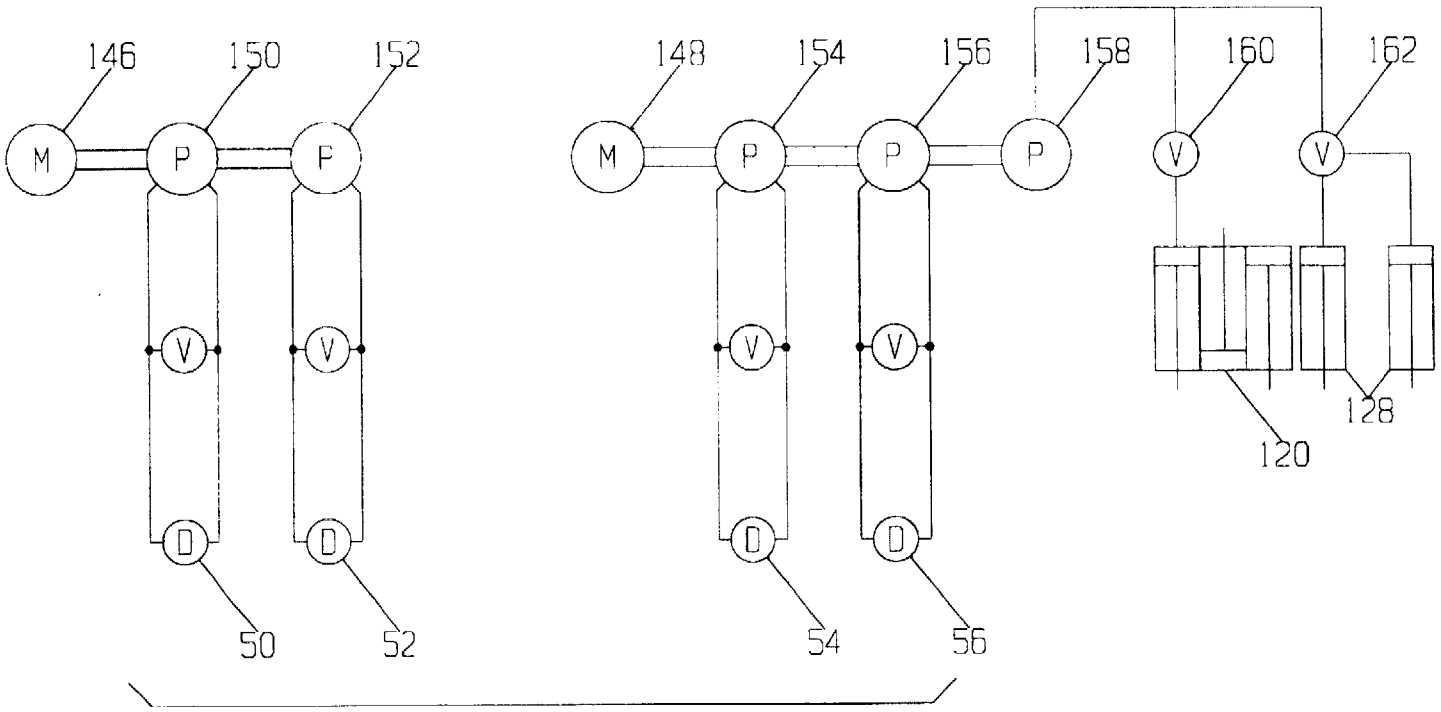
FIG. 6 is a schematic diagram of the hydraulic circuitry of the shear shredder of FIG. 1.

The system for powering the various components of the shear shredder 10 is shown schematically in FIG. 6. A pair of drive motors 146, 148 each power a pair of pumps 150, 152, 154, 156, respectively. In addition, electric drive motor 148 powers pump 158 which supplies hydraulic pressure through valves 160, 162 to the cylinders 120, 128 in the feed ram 108 (See also FIG. 10).

Pumps 150, 152 are connected to and supply pressurized hydraulic fluid to hydraulic cartridge drive motors 50, 52, respectively. Similarly, hydraulic pumps 154, 156 are connected to and supply pressurized hydraulic fluid to hydraulic cartridge drive motors 54, 56 respectively. Consequently, each of the shear cartridges 62, 64 receives power from both electric drive motors 146, 148. Specifically, shear cartridge 62 is rotated by drive motors 54, 50 and shear cartridge 64 receives rotational power from drive motors 56, 52.

As a result of this arrangement, should either of the shear cartridges 62, 64 become jammed, the power from both of the motors 146, 148 is directed to the hydraulic drive motors powering that shear cartridge. Thus, smaller electric drive motors 146, 148 may be used since their power is combined in operational conditions which require greater power.

As a result of the structure of the shear shredder, the insertion and replacement of the shredder cartridges 62, 64 is facilitated. For example, should it be necessary to replace shear cartridge 62 in the field, the following sequence of steps is performed. First, side wall 18 is removed from the support frame 12, which disengages the associated comb elements 59 from the cutter elements 68 of cartridge 62. Inserts 88, 92 are unbolted from engagement with end walls 42, 44. If necessary, the stack tighteners 72, 74 are loosened by appropriate adjustment of the screws 86, which allows the cutter elements 68 to separate from the spacer elements 70 slightly. This step may be performed prior to the removal of side wall 18 in order to facilitate disengagement with the comb elements 60.

The cartridge 62 is then supported by a jack (not shown) to cradle it and the end caps 78, 80 are unbolted from their connection to the face plates 96 of the hydraulic drive motors 50, 54. The cartridge 62 can then be removed from the support frame 12 by a fork lift or the like.

The end walls 46, 48 are also easily removable. In order to assure proper alignment, in the preferred embodiment, the end walls 46, 48 are located in position with high precision by dowel pins (not shown). In order to remove the end walls 46, 48, they are unbolted, the dowel pins removed and the end walls, along with the drive motors 50–56 can be lifted upwardly by a crane. Of course, the upward removal of the end walls 46, 48 requires removal of the end wall housings 22, 24 from the support frame 12.

It is apparent, therefore, that the cartridges 62, 64 are modular in design and can be reversed end-for-end and inserted in the support frame 12, if required. Further, the shear cartridges 62, 64 can be of identical construction and selected from among an inventory of identical shear cartridges. Similarly, the end walls 46 and 48 and motors 50–56 are modular in construction and can be selected from among an inventory of substantially identical components. For proper alignment of the end walls 46, 48 which is desired to effect a proper alignment of the shear cartridges 62, 64, the portions of the support frame 12 which receive the end walls 46, 48 only need to be machined to a high precision, and not other components of the frame.

Also in the preferred embodiment, the hydraulic drive motors 50, 52, 54, 56 are controlled by the use of swash plates, rather than valves, which promotes efficiency of operation.

While the form of apparatus herein described constitutes a preferred embodiment of the invention, it is to be understood that other forms of apparatus may be employed without departing from the scope of the invention.

What is claimed is:

1. A shear cartridge for a modular shear shredder, said shear cartridge comprising:

a shaft;

a plurality of cutter elements mounted on said shaft;

a pair of attachment plates, each directly coupled to a separate drive motor; and a pair of end caps, each removably mounted on an end of said shaft, each of said end caps being attached to an associated one of said attachment plates.

2. The shear cartridge of claim 1 wherein said end cap means includes stack tightener means slidably mounted on said shaft outside of said cutter elements; end caps attached to said shaft ends; and adjustable bolt means extending between said end caps and said stack tightener means, said bolt means being adjustable to urge said stack tightener means inwardly to compress said cutter elements together.

3. The shear shredder of claim 1 wherein said end caps are mounted on the ends of said shaft so as to hold said cutter elements on said shaft.

4. The shear cartridge of claim 1 wherein said shaft has a hexagonal cross-section.

5. The shear cartridge of claim 1 wherein said end caps are retained on said shaft by fasteners.

6. A shear cartridge for a modular shear shredder, said shear cartridge comprising:

a shaft;

a plurality of cutter elements mounted on said shaft; and a pair of end caps removably mounted on ends of said shaft, said end caps being shaped to attach to an associated support bearing and coupled directly to an associated drive motor, wherein said end caps have substantially flat end surfaces which are adapted to be connected to either said support bearing or said drive motor, and wherein the end caps are removably bolted to connections on said associated drive motor.

7. The shear cartridge of claim 1 further comprising a plurality of spacer rings mounted on said shaft between said cutter elements.

8. The shear cartridge of claim 7 further comprising stack tighteners mounted on said shaft wherein when said stack tighteners are displaced towards one another said cutter elements and said spacers are tightened against each other.

9. The shear cartridge of claim 8 where in s aid end caps are shaped to hold said cutter elements, said spacers and said stack tighteners on said shaft.

10. The shear cartridge of claim 9 further comprising jam nut and wedge bolt combinations extending between said end caps and said stack tighteners wherein said jam nut and wedge bolt combination displace said stack tighteners with respect to one another.

* * * * *